US011854723B2

(12) United States Patent
Chen et al.

(10) Patent No.: US 11,854,723 B2
(45) Date of Patent: Dec. 26, 2023

(54) PTC DEVICE INCLUDING POLYSWITCH

(71) Applicant: Littelfuse Electronics (Shanghai) Co., Ltd., Shanghai (CN)

(72) Inventors: Jianhua Chen, Shanghai (CN); Bing Wang, Shanghai (CN); Pinghong Li, Shanghai (CN); Cheng Hu, Shanghai (CN)

(73) Assignee: LITTELFUSE ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/057,386

(22) PCT Filed: Mar. 22, 2019

(86) PCT No.: PCT/CN2019/079251
§ 371 (c)(1),
(2) Date: Nov. 20, 2020

(87) PCT Pub. No.: WO2020/191522
PCT Pub. Date: Oct. 1, 2020

(65) Prior Publication Data

US 2021/0202138 A1 Jul. 1, 2021

(51) Int. Cl.
*H01C 1/14* (2006.01)
*H01C 1/148* (2006.01)
(Continued)

(52) U.S. Cl.
CPC ..... *H01C 1/1406* (2013.01); *H01C 1/148* (2013.01); *H01C 7/02* (2013.01); *H01C 17/28* (2013.01)

(58) Field of Classification Search
CPC ..... H01C 1/1406; H01C 1/148; H01C 7/02; H01C 17/28
See application file for complete search history.

(56) References Cited

U.S. PATENT DOCUMENTS 5,534,843 A * 7/1996 Tsunoda ..... H01C 1/034 338/22 R
5,852,397 A * 12/1998 Chan ..... H05K 3/3442 338/22 R
(Continued)

FOREIGN PATENT DOCUMENTS

CN 203311954 U 11/2013
CN 103595213 A 2/2014
(Continued)

OTHER PUBLICATIONS

International Search Report and Written Opinion dated Dec. 26, 2019 for PCT/CN2019/079251.
(Continued)

*Primary Examiner* — Kyung S Lee
(74) *Attorney, Agent, or Firm* — KDW Firm PLLC

(57) ABSTRACT

Approaches provided herein include a protection device assembly having a protection component and a first electrode layer extending along a first main side of the protection component. The first electrode layer may include a first section separated from a second section by a first gap. The assembly may further include a second electrode layer extending along a second main side of the protection component, the second electrode layer including a third section separated from a fourth section by a second gap, wherein the first gap is aligned with the second gap. The assembly may further include a first insulation layer disposed over the first electrode layer, and a second insulation layer disposed over the second electrode layer. The assembly may further include a solder pad extending around an end of the protection component, the solder pad further extending over the first insulation layer and the second insulation layer.

13 Claims, 9 Drawing Sheets

(51) Int. Cl.
*H01C 7/02* (2006.01)
*H01C 17/28* (2006.01)

(56) References Cited

U.S. PATENT DOCUMENTS

| | | | | |
|---|---|---|---|---|
| 6,172,592 | B1 * | 1/2001 | Inoue | H05B 3/20 338/22 R |
| 6,285,275 | B1 * | 9/2001 | Chen | H01C 1/1406 338/22 R |
| 6,292,088 | B1 | 9/2001 | Zhang et al. | |
| 6,380,839 | B2 | 4/2002 | Li et al. | |
| 6,441,717 | B1 * | 8/2002 | Ikeda | H01C 7/028 338/22 R |
| 7,102,483 | B2 * | 9/2006 | Hwang | H01C 7/021 338/22 R |
| 8,830,027 | B2 † | 9/2014 | Sha | |
| 8,933,775 | B2 † | 1/2015 | Wang | |
| 9,041,507 | B2 * | 5/2015 | Wang | H01C 7/021 338/22 R |
| 9,959,958 | B1 | 5/2018 | Chen | |
| 2002/0021203 | A1 | 2/2002 | Kojima et al. | |
| 2004/0214418 | A1 | 10/2004 | Noda et al. | |
| 2006/0176675 | A1 | 8/2006 | Bourns et al. | |
| 2012/0057265 | A1 * | 3/2012 | Lien | H01C 7/112 361/124 |
| 2013/0187748 | A1 * | 7/2013 | Sha | H01C 7/008 338/22 R |
| 2013/0284501 | A1 * | 10/2013 | McConnell | H05K 3/301 29/827 |
| 2014/0049357 | A1 * | 2/2014 | Tseng | H01C 1/1406 338/22 R |
| 2020/0273609 | A1 * | 8/2020 | Tseng | H01C 7/13 |

FOREIGN PATENT DOCUMENTS

| | | | |
|---|---|---|---|
| CN | 203631462 | U | 6/2014 |
| CN | 111696738 | A | 9/2020 |
| JP | H10144504 | A | 5/1998 |
| JP | H1187105 | A | 3/1999 |
| JP | 2000150203 | A | 5/2000 |
| JP | 2005093983 | A | 4/2005 |
| TW | I366848 | B | 6/2012 |
| WO | 2013039227 | A1 | 3/2013 |

OTHER PUBLICATIONS

Extended European Search Report for EP19921603.7, dated Mar. 14, 2022.

* cited by examiner
† cited by third party

PTC DEVICE INCLUDING POLYSWITCH

FIELD OF THE DISCLOSURE

The disclosure relates generally to polymeric temperature coefficient devices and, more particularly to small package size devices including a polyswitch.

BACKGROUND OF THE DISCLOSURE

One known resettable fuse is a positive temperature coefficient ("PTC") device. PTC thermistor materials rely on a physical characteristic germane to many conductive materials, namely, that the resistivity of the conductive materials increases with temperature. Crystalline polymers made electrically conductive via the disbursement of conductive fillers therein, exhibit this PTC effect. The polymers generally include polyolefins such as polyethylene, polypropylene and ethylene/propylene copolymers. Certain doped ceramics such as barium titanate also exhibit PTC behavior.

The conductive fillers cause the resistivity of the PTC thermistor material to increase as the temperature of the material increases. At temperatures below a certain value, the PTC thermistor material exhibits a relatively low, constant resistivity. However, as the temperature of the PTC thermistor material increases beyond this point, the resistivity increases sharply with only a slight increase in temperature.

If a load protected by a PTC thermistor material is short circuited, the current flowing through the PTC thermistor material increases and the temperature of the PTC thermistor material (due to the above-mentioned $i^{2R}$ heating) rises rapidly to a critical temperature. At the critical temperature, the PTC thermistor material dissipates a great deal of power causing the rate at which the material generates heat to be greater than the rate at which the material can lose heat to its surroundings. The power dissipation only occurs for a short period of time (e.g., a fraction of a second). However, the increased power dissipation raises the temperature and resistance of the PTC thermistor material, limiting the current in the circuit to a relatively low value. The PTC thermistor material accordingly acts as a form of a fuse.

Upon interrupting the current in the circuit, or removing the condition responsible for the short circuit, the PTC thermistor material cools below its critical temperature to its normal operating, low resistance state. The result is a resettable overcurrent circuit protection material.

Even though the PTC thermistor materials operate at lower resistances under normal conditions, the normal operating resistances for PTC thermistor materials are higher than that of other types of fuses, such as non-resettable metallic fuses. The higher operating resistance results in a higher voltage drop across the PTC thermistor material than for similarly rated non-resettable metallic fuses. Voltage drop and power dissipation is becoming increasingly important to circuit designers, who are attempting to maximize the drive capability of a particular circuit as well as battery life.

Accordingly, an improved small package size device is needed.

SUMMARY

In one or more embodiments, a protection device assembly includes a protection component and a first electrode layer extending along a first main side of the protection component. The first electrode layer may include a first section separated from a second section by a first gap. The assembly may further include a second electrode layer extending along a second main side of the protection component, the second electrode layer including a third section separated from a fourth section by a second gap, wherein the first gap is aligned with the second gap. The assembly may further include a first insulation layer disposed over the first electrode layer, and a second insulation layer disposed over the second electrode layer. The assembly may further include a solder pad extending around an end of the protection component, the solder pad further extending over the first insulation layer and the second insulation layer.

In one or more embodiments, a positive temperature coefficient (PTC) device includes a PTC protection component and a first electrode layer extending along a first main side of the PTC protection component, wherein the first electrode layer includes a first section separated from a second section by a first gap. The PTC device may further include a second electrode layer extending along a second main side of the PTC protection component, the second electrode layer including a third section separated from a fourth section by a second gap, wherein the first gap is aligned with the second gap. The PTC device may further include a first insulation layer disposed over the first electrode layer, and a second insulation layer disposed over the second electrode layer, wherein the first insulation layer is formed within the first gap, and wherein the second insulation layer is formed within the second gap. The PTC device may further include a solder pad extending around an end of the PTC protection component, the solder pad further extending over the first insulation layer and the second insulation layer.

In one or more embodiments, a method of forming a positive temperature PTC device may include providing a PTC protection component, and forming a first electrode layer along a first main side of the PTC protection component. The first electrode layer may include a first section separated from a second section by a first gap. The method may further include forming a second electrode layer along a second main side of the PTC protection component, the second electrode layer including a third section separated from a fourth section by a second gap, wherein the first gap is aligned with the second gap. The method may further include providing a first insulation layer over the first electrode layer, and providing a second insulation layer over the second electrode layer. The method may further include forming a solder pad around an end of the PTC protection component, the solder pad further extending over the first insulation layer and the second insulation layer.

BRIEF DESCRIPTION OF THE DRAWINGS

The accompanying drawings illustrate example approaches of the disclosed embodiments so far devised for the practical application of the principles thereof, and in which.

Figure 1:
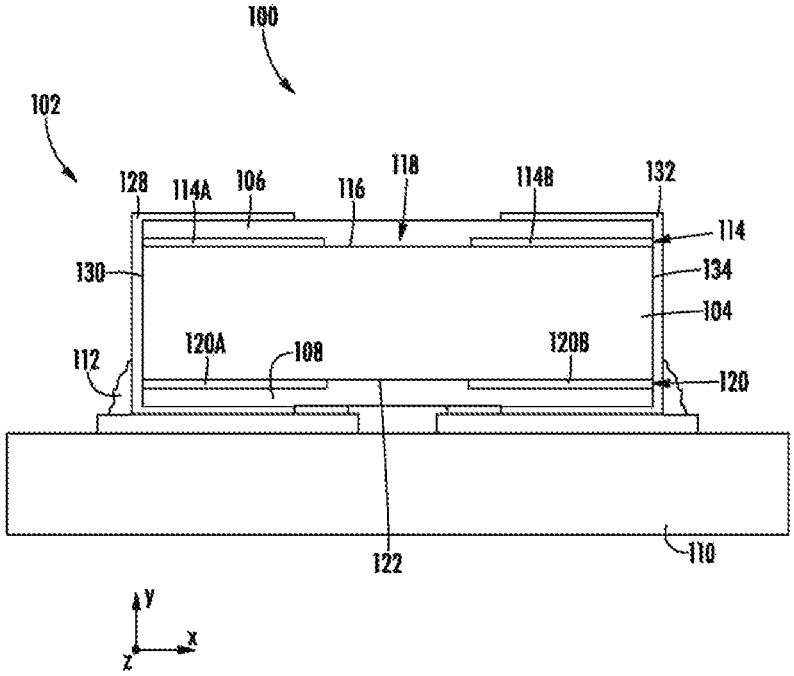
FIG. 1 is a side cross-sectional view of an assembly according to an example approach of the disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The apparatuses, devices, and methods may be embodied in many different forms and should not be construed as being limited to the embodiments set forth herein. Rather, these embodiments are provided so that this disclosure will be thorough and complete, and will fully convey the scope of the system and method to those skilled in the art.

Figure 2:
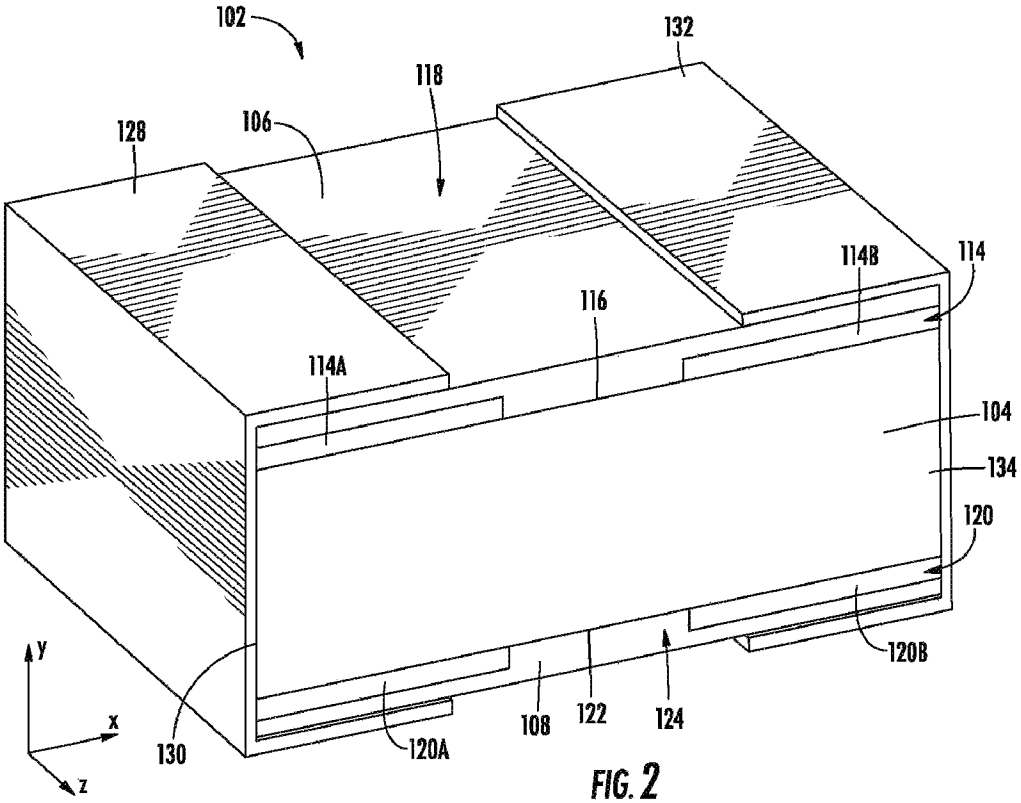
FIG. 2 is a perspective view of a device of the assembly of FIG. 1 according to an example approach of the disclosure.

Turning to FIGS. 1-2, illustrated is an embodiment of an apparatus 100 and a device 102 in accordance with the present disclosure. As shown, the device 102, may be a PTC device or a polymeric PTC device. In some embodiments, the device 102 may be an Electronic Industries Alliance (EIA) surface mount device, type 0201. The device 102 includes a protection component 104 disposed between a first insulation layer 106 and a second insulation layer 108. In some embodiments, the first insulation layer 106 and the second insulation layer 108 are made of a same material, such as an FR-4 material or a polyimide. The illustrated device 102 may be located in, for example, a charge/discharge circuit of a secondary cell, and used as a circuit protection device to interrupt an excess current when such current passes through the circuit. As shown, the device 102 may be connected to a printed circuit board (PCB) 110 by a solder 112.

In some embodiments, the protection component 104 is selected from the non-limiting group consisting of: fuses, PTCs, NTCs, ICs, sensors, MOSFETS, resistors, and capacitors. Of these protection components, ICs and sensors are considered to be active protection components, while PTCs, NTCs, and fuses are considered to be passive components. In the embodiment shown, the protection component 104 may be a polymeric PTC. It will be appreciated, however, that this arrangement is non-limiting, and the number and configuration of protection components may vary depending on the application.

The PTC material of the protection component 104 may be made of a positive temperature coefficient conductive composition comprising a polymer and a conductive filler. The polymer of the PTC material may be a crystalline polymer selected from the group consisting of polyethylene, polypropylene, polyoctylene, polyvinylidene chloride and a mixture thereof. The conductive filler may be dispersed in the polymer and is selected from the group consisting of carbon black, metal powder, conductive ceramic powder and a mixture thereof. Furthermore, to improve sensitivity and physical properties of the PTC material, the PTC conductive composition may also include an additive, such as a photo initiator, cross-link agent, coupling agent, dispersing agent, stabilizer, anti-oxidant and/or nonconductive anti-arcing filler.

As shown, a first electrode layer 114 may extend along a first main side 116 of the protection component 104, the first electrode layer 114 including a first section 114A separated from a second section 114B by a first gap 118. A second electrode layer 120 may extend along a second main side 122 of the protection component 104, the second electrode layer 120 including a third section 120A separated from a fourth section 120B by a second gap 124. As shown, the first gap 118 is substantially aligned (e.g., vertically along the y-direction) with the second gap 124. The first insulation layer 106 may be disposed over the first electrode layer 114, while the second insulation layer 108 may be disposed around/over the second electrode layer 120 such that the second electrode layer 120 is between the second main side 122 of the protection component 104 and the second insulation layer 108. As shown, the first insulation layer 106 is present or formed within the first gap 118, and the second insulation layer 108 is present or formed within the second gap 124. Said differently, the first and second gaps 118 and 124 represent areas of the first and second insulations layers 106 and 108, respectively, where no conductive material of the first and second electrode layers 114, 120 is present.

The first electrode layer 114 and the second electrode layer 120 may be made from copper. However, it will be appreciated that alternative materials may be used. For example, the first and second electrode layers 114, 120 can be of one or more metals, such as silver, copper, nickel, tin and alloys thereof, and may be applied to the first and second main sides 116, 122 and/or a surface of the first insulation layer 106 and the second insulation layer 108 by any number of ways. For example, the first electrode layer 114 and the second electrode layer 120 can be applied via electroplating, sputtering, printing or laminating.

As further shown, a first solder pad 128 may extend around a first end 130 of the protection component 104, and a second solder pad 132 may extend around a second end 134 of the protection component 104. In some embodiments, the first solder pad 128 and the second solder pad 132 may be formed along the first insulation layer 106 and the second insulation layer 108. The first and second solder pads 128, 132 may be terminations formed by, for example, standard plating techniques. The terminations can be multiple layers of metal, such as electrolytic copper, electrolytic tin, silver, nickel or other metal or alloy as desired. The terminations are sized and configured to enable the device 102 to be mounted in a surface mount manner onto the PCB 110.

Figure 3A:
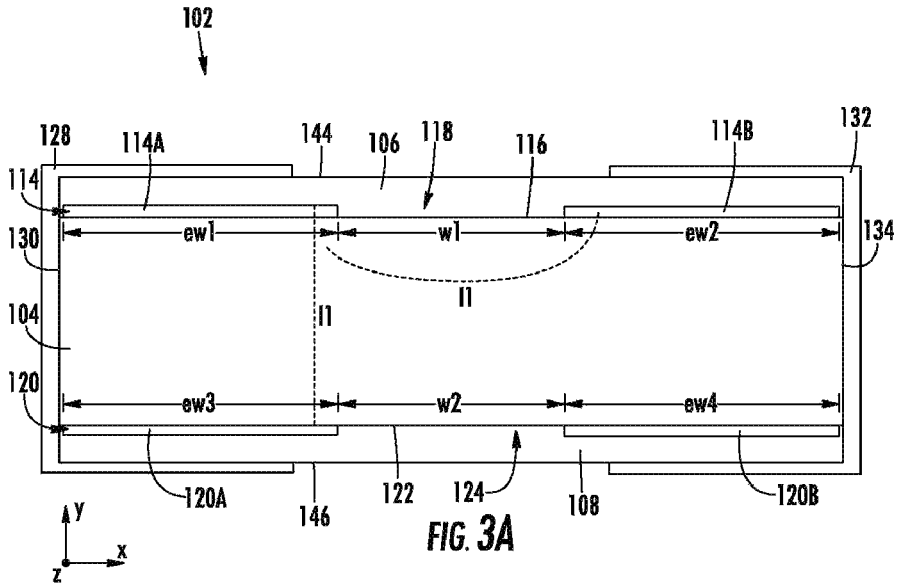
FIG. 3A is a side cross-sectional view of the device of the assembly of FIG. 1 according to an example approach of the disclosure.

Turning now to FIG. 3A, the device 102 according to embodiments of the present embodiments will be described in greater detail. As shown, the protection component 104 includes the first main side 116 opposite the second main side 122, the first end 130 opposite the second end 134, and a first side 140 opposite a second side (not visible). In this embodiment, the first gap 118 between the first and second sections 114A, 114B of the first electrode layer 114 has a first gap width, 'w1.' The second gap 124 between the third and fourth sections 120A, 120B of the second electrode layer 120 has a second gap width, 'w2.' As shown, w1 is substantially equal to w2. In other embodiments w1 is not equal to w2.

As further shown, the first section 114A has a first electrode width, 'ew1,' the second section 114B has a second electrode width, 'ew2,' the third section 120A has a third electrode width, 'ew3,' and the fourth section 120B has a fourth electrode width, 'ew4.' In some embodiments, the ew1 is approximately equal to ew3, and ew2 is approximately equal to ew4. In some embodiments, ew1=ew2=ew3=ew4. Although non-limiting, ew1 and ew3 may be greater than a width of the first solder pad 128 extending horizontally (e.g., in the x-direction) along outer surfaces 144 and 146, respectively, of the first insulation layer 106 and the second insulation layer 108. Similarly, ew2 and ew4 may be greater than a width of the second solder pad 132 extending along outer surfaces 144 and 146. Furthermore, the first section 114A may be substantially vertically aligned over the third section 120A, while the second section 114B may be substantially vertically aligned over the fourth section 120B.

As configured, during use, current I1 may flow from the first section 114A to either the second section 114B or the third section 120A. Similarly, current may flow from the third section 120A to the first section 114A or to the fourth section 120B. Embodiments herein are not limited in this context however. By allowing current to flow horizontally (e.g., in the x-direction) across the first gap 118 from the first section 114A to the second section 114B, the device 102 offers a more robust structure, which enables better process control. In some embodiments, w1 and w2 may be selected to ensure the current may flow horizontally.

Figure 3B:
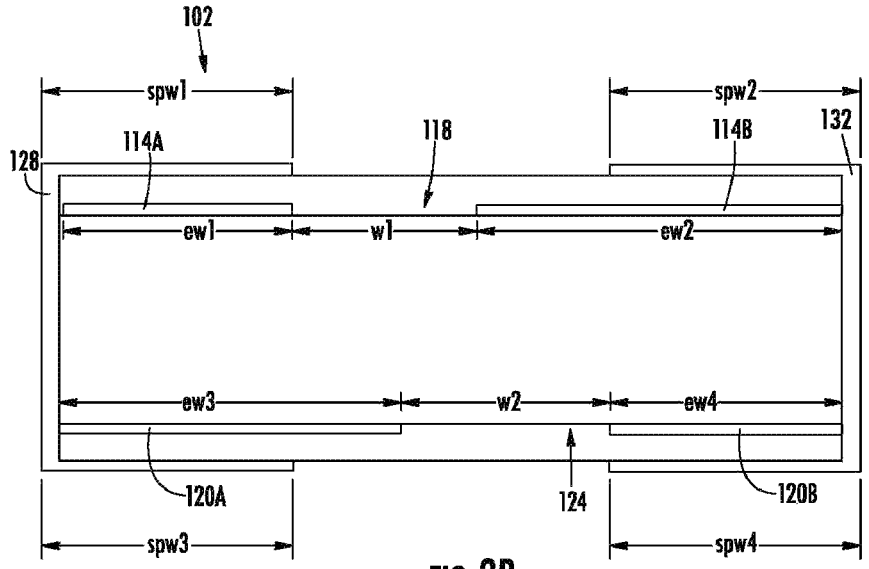
FIG. 3B is a side cross-sectional view of an alternative device according to an example approach of the disclosure.
Figure 4:
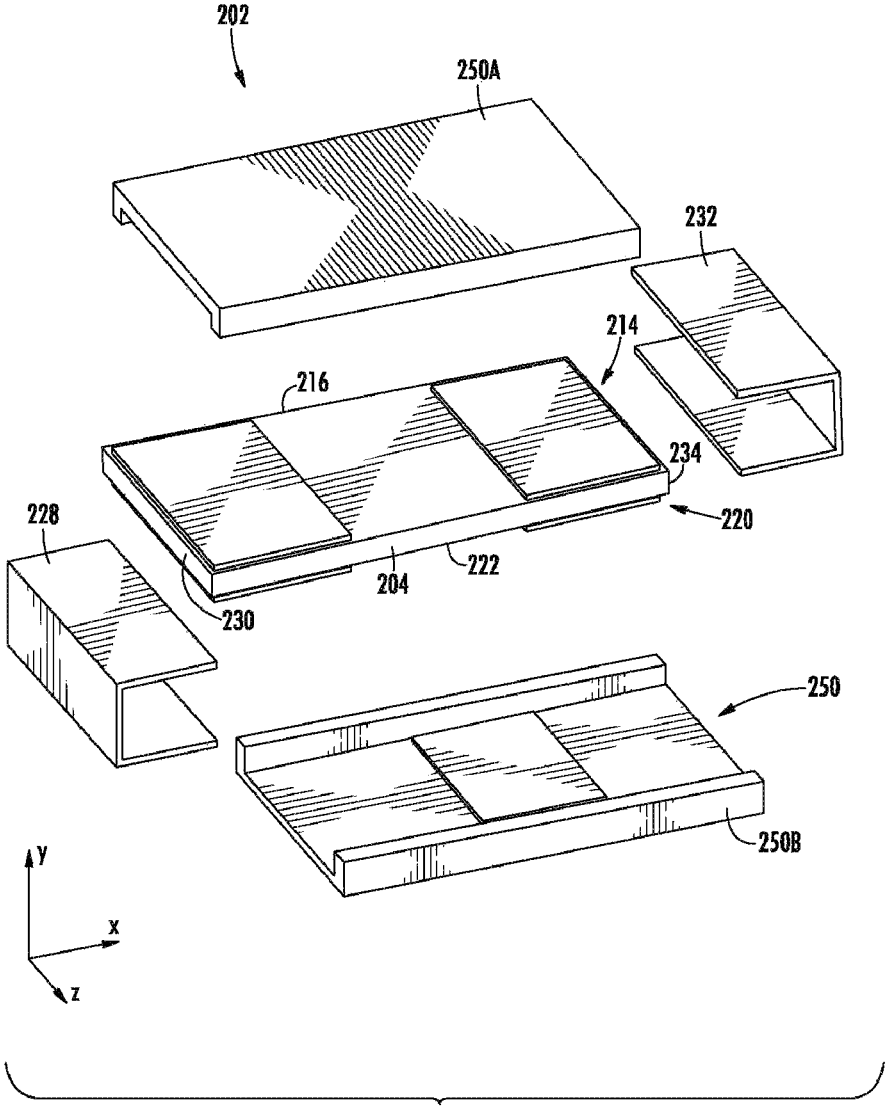
FIG. 4 is a perspective view of a device including an encapsulation covering according to an example approach of the disclosure.
Figure 5:
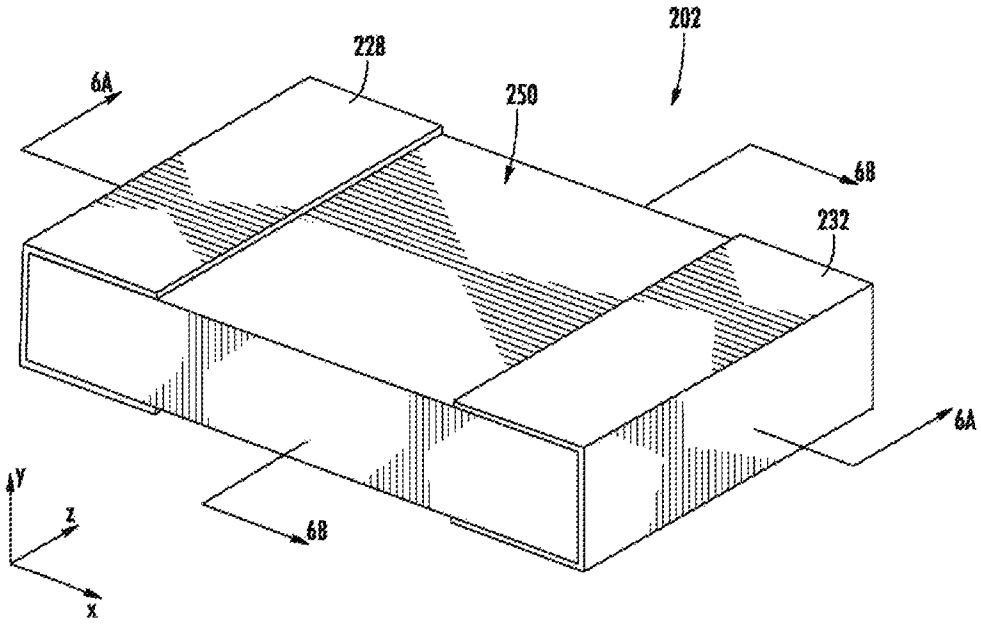
FIG. 5 is an exploded view of the device of FIG. 4 according to an example approach of the disclosure.
Figure 6A:
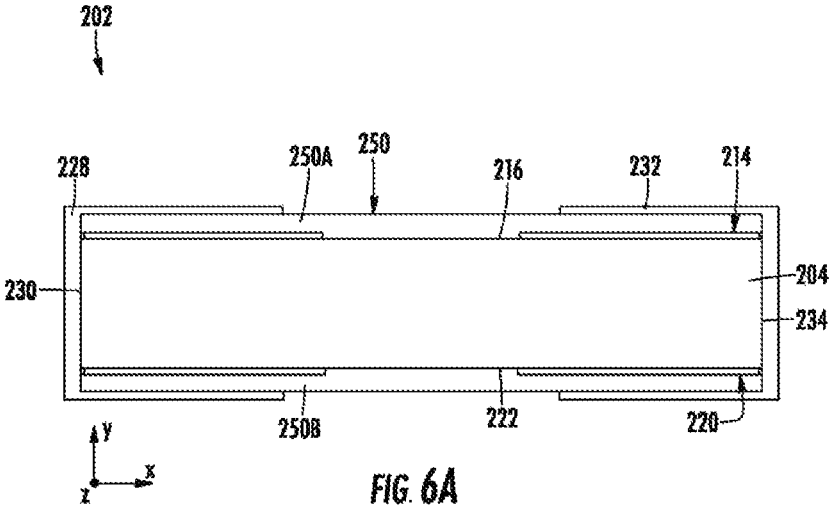
FIGS. 6A-6B are cross-sectional views of the device of FIG. 4 according to an example approach of the disclosure.
Figure 6B:
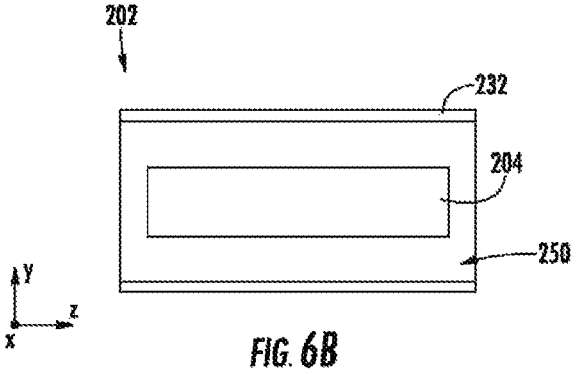
Figure 7A:
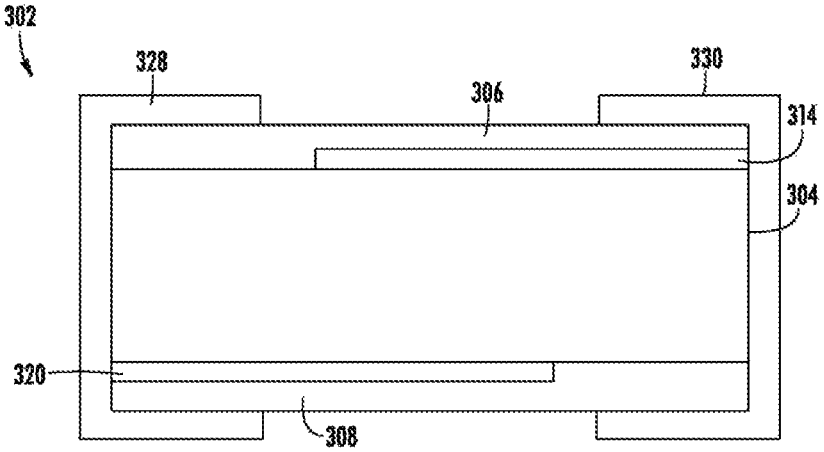
FIGS. 7A-7D are cross-sectional views of various devices according to example approaches of the disclosure.
Figure 7B:
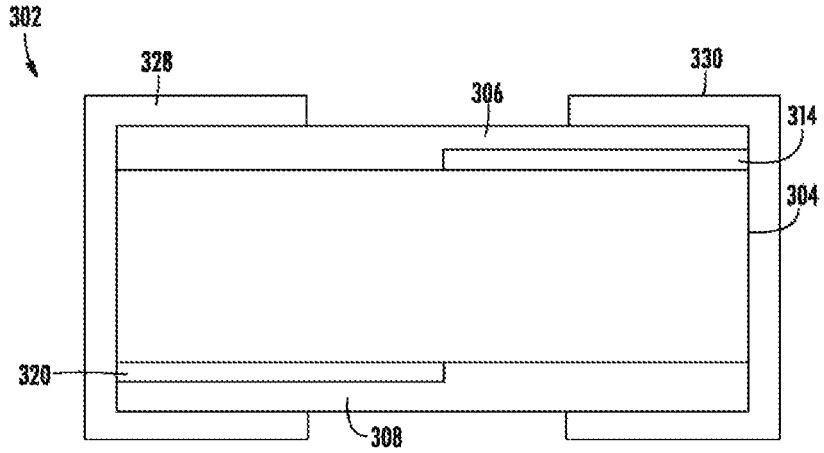
Figure 7C:
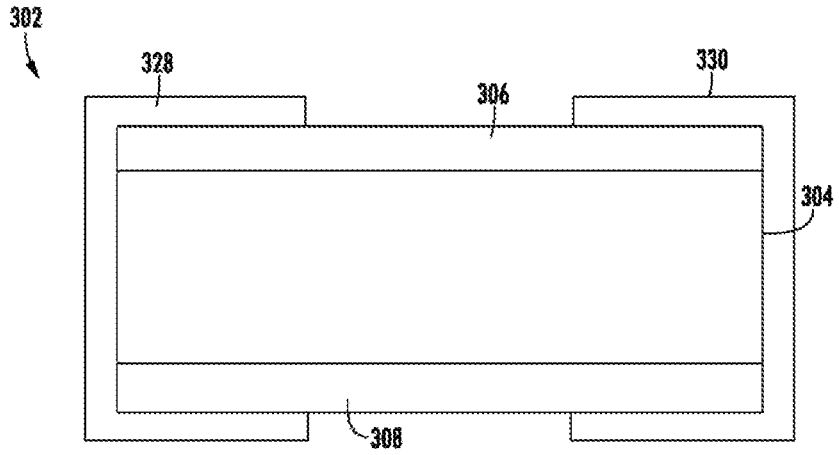
Figure 7D:
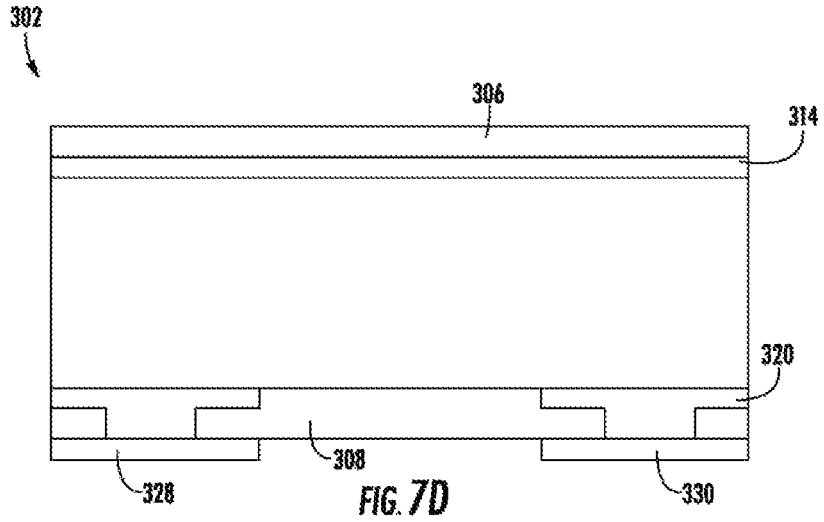

In FIG. 3B, the first section 114A has a first electrode width, 'ew1,' the second section 114B has a second electrode width, 'ew2,' the third section 120A has a third electrode width, 'ew3,' and the fourth section 120B has a fourth electrode width, 'ew4.' As shown, ew1 is not equal to ew3, and ew2 is not equal to ew4. Instead, ew1 may be approximately equal to ew4, and ew2 may be approximately equal to ew3. Although non-limiting, ew1 may be approximately equal to a first solder pad width 'spw1' of the first solder pad 128, and ew3 may be approximately equal to a third solder pad width 'spw3' of the first solder pad 128. Similarly, ew2 may be greater than a second solder pad width 'spw2' of the second solder pad 132, while ew4 may be greater than a fourth solder pad width 'spw4' of the second solder pad 132. Furthermore, the first section 114A may be substantially vertically aligned over the third section 120A, while the second section 114B may be substantially vertically aligned over the fourth section 120B. However, ew2 is greater than ew4, and ew3 is greater than ew1. As a result, the first gap 118 may be horizontally offset, e.g., along the x-direction, from the second gap 124. In some embodiments, w1 is substantially equal to w2. In other embodiments w1 is not equal to w2.

As configured, during use, current may flow from the first section 114A to either the second section 114B or the third section 120A. Similarly, current may flow from the third section 120A to the first section 114A, the second section 114B, or to the fourth section 120B. Due to the distance between the first section 114A and the fourth section 120B, it is less likely that current will flow between these two components. Embodiments herein are not limited in this context however. By allowing current to flow horizontally (e.g., in the x-direction) across the first gap 118 from the first section 114A to the second section 114B, and horizontally across the second gap 124 from the third section 120A to the fourth section 120B, the device 102 offers a more robust structure, which enables better process control. In some embodiments, w1 and w2 may be selected to ensure the current may flow horizontally.

Turning now to FIGS. 4-6B, a device 202 according to embodiments of the present disclosure will be described in greater detail. The device 202 may be similar in many aspects to the device 102 described above. Accordingly, only certain aspects of the device 202 will hereinafter be described for the sake of brevity. As shown, the device 202 may include a protection component 204 disposed between a first electrode layer 214 and a second electrode layer 220. The first electrode layer 214 may extend laterally (e.g., in the x-direction) along a first main side 216 of the protection component 204, while the second electrode layer 220 may extend laterally along a second main side 222 of the protection component 204.

In this embodiment, a first insulation or encapsulation layer 250A and a second insulation or encapsulation layer 250B together form an encapsulation covering 250 surrounding each of: the protection component 204, the first electrode layer 214, and the second electrode layer 220. As shown, the encapsulation covering 250 extends over four (4) sides of the protection component 204, for example, the first main side 216, the second main side 222, the first end 230, and the second end 234. In other embodiments, the encapsulation covering 250 may extend over all six (6) sides of the protection component 204. Although non-limiting, the encapsulation covering 250 may an electrically insulating epoxy, which is printed, sprayed, injected or otherwise applied over the protection component 204, the first electrode layer 214, and the second electrode layer 220. The first and second solder pads 228, 232 may then be positioned/formed over the encapsulation covering 250. The encapsulation covering 250 may reduce resistance (e.g., 0.1-0.25 ohms) of the device 202, and keep it relatively constant over an extended period of time (e.g., 1000 hours).

In some embodiments, the encapsulation covering 250 may be a multiple-layer structure with different layers providing different functions. For example, one example 3-layer structure of the encapsulation covering 250 may include a first layer which is oxidization-resistant epoxy, a second layer that is humidity-resistant epoxy, and a third layer that is corrosion-resistant epoxy. It will be appreciated, however, that this tri-layered arrangement is non-limiting, and the number and layers of the encapsulation covering 250 may vary depending on the application.

Turning now to FIGS. 7A-7D, devices 302 according to various alternative embodiments of the present disclosure are shown. In each of the embodiments, reference number 304 is a protection component, reference number 306 is a first insulation layer, reference number 308 is a second insulation layer, reference number 314 is a first electrode layer, reference 320 is a second electrode layer, reference number 328 is a first solder pad, and reference number 332 is a second solder pad. The devices 302 may be similar in many aspects to the devices 102 and 202 described above. Accordingly, the devices 302 will not hereinafter be described for the sake of brevity.

Figure 8:
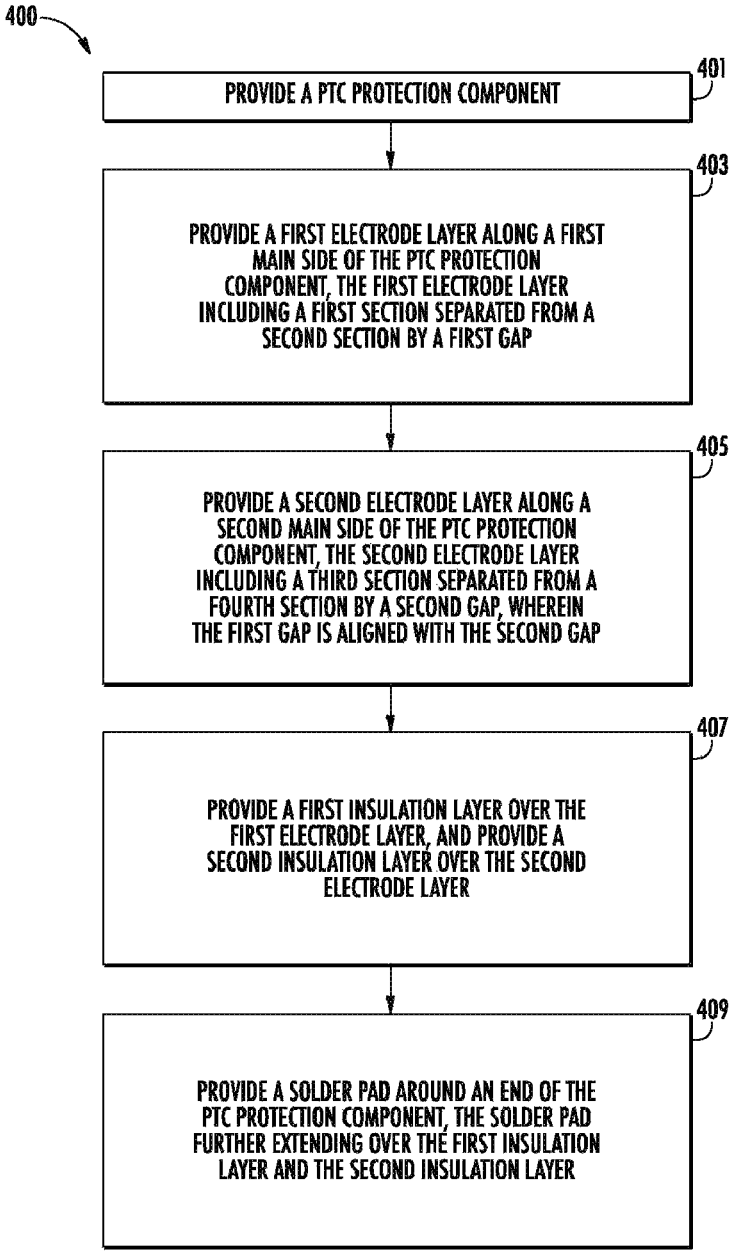
FIG. 8 depicts a process of forming a PTC device according to an example approach of the disclosure.

Turning now to FIG. 8, a method 400 for forming a positive temperature PTC according to embodiments of the present disclosure will be described. At block 401, the method 400 may include providing a PTC protection component. At block 403, the method may include forming a first electrode layer along a first main side of the PTC protection component, the first electrode layer including a first section separated from a second section by a first gap. At block 405, the method 400 may include forming a second electrode layer along a second main side of the PTC protection component, the second electrode layer including a third section separated from a fourth section by a second gap, wherein the first gap is aligned with the second gap.

In some embodiments, the first gap is substantially equal to the second gap. In some embodiments, the first section has a first electrode width, the second section has a second electrode width, the third section has a third electrode width, and the fourth section has a fourth electrode width. The first electrode width is approximately equal to the third electrode width, and the second electrode width is approximately equal to the fourth electrode width. Furthermore, the first section of the first electrode layer may be substantially vertically aligned over the third section of the second electrode layer. Still furthermore, the second section of the first electrode layer may be substantially vertically aligned over the fourth section of the second electrode layer.

At block 407, the method 400 may include providing a first insulation layer over the first electrode layer, and providing a second insulation layer over the second electrode layer. In some embodiments, the first insulation layer and the second insulation layer are made of a same material, such as an FR-4 material or a polyimide.

At block 409, the method 400 may include providing a solder pad around an end of the PTC protection component, the solder pad further extending over the first insulation layer and the second insulation layer. In some embodiments, a second solder pad extends around a second end of the PTC protection component, the second solder pad also extending over the first insulation layer and the second insulation layer. In some embodiments, prior to forming the first and second solder pads, an encapsulation covering is provided around each of: the protection component, the first electrode layer, and the second electrode layer. The first and second solder pads may then be provided over the encapsulation covering.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

Still furthermore, although the illustrative method 400 is described above as a series of acts or events, the present disclosure is not limited by the illustrated ordering of such acts or events unless specifically stated. For example, some acts may occur in different orders and/or concurrently with other acts or events apart from those illustrated and/or described herein, in accordance with the disclosure. In addition, not all illustrated acts or events may be required to implement a methodology in accordance with the present disclosure. Furthermore, the method 400 may be implemented in association with the formation and/or processing of structures illustrated and described herein as well as in association with other structures not illustrated.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A protection device assembly, comprising:

a protection component;

a first electrode layer positioned directly atop a first main side of the protection component, wherein the first electrode layer extends in a first direction, between a first end and a second end of the protection component;

a second electrode layer in direct contact with a second main side of the protection component;

a first insulation layer disposed over the first electrode layer and a second insulation layer disposed over the second electrode layer; and a solder pad in direct contact with only the second insulation layer and the second electrode layer, wherein the second electrode layer includes a first section separated from a second section by a gap, wherein the gap extends in a second direction, perpendicular to the first direction, and wherein the first and second sections of the second electrode layer comprise:

a first portion extending horizontally along the second main side of the protection component; and a second portion extend perpendicularly from the first portion, wherein the second portion passes through the second insulation layer and directly contacts only the solder pad, the first section, and the second insulation layer, and wherein the second insulation layer passes completely around the second portion, wherein the first portion of the first section and the first portion of the second section are separated from one another, in the second direction, by the second insulation, and wherein the second insulation extends into the gap.

2. The protection device assembly of claim 1, further comprising a second solder pad, wherein the second solder pad extends over the second insulation layer, and wherein the first and second solder pads are not in direct contact with the protection component.

3. The protection device assembly of claim 2, further comprising a printed circuit board, wherein the first and second solder pads are connected to the printed circuit board by a solder.

4. The protection device assembly of claim 1, wherein the first electrode width, in a horizontal direction, is approximately equal to a width of the protection component, in the horizontal direction.

5. The protection device assembly of claim 1, wherein the first insulation layer and the second insulation layer form an encapsulation covering surrounding each of: the protection component, the first electrode layer, and the second electrode layer.

6. The protection device assembly of claim 5, wherein the protection component includes the first main side opposite the second main side, an end opposite a second end, and a first side opposite a second side, and wherein the encapsulation covering extends over each of: the first main side, the second main side, the end, and the second end.

7. A positive temperature coefficient (PTC) device, comprising:

a PTC protection component;

a first electrode layer positioned directly atop a first main side of the PTC protection component, wherein the first electrode layer extends in a first direction, between a first end and a second end of the PTC protection component;

a second electrode layer in direct contact with a second main side of the PTC protection component;

a first insulation layer disposed over the first electrode layer, and a second insulation layer disposed over the second electrode layer; and a solder pad in direct contact with only the second electrode layer and the second insulation layer, wherein the second electrode layer includes a first section separated from a second section by a gap, wherein the gap extends in a second direction, perpendicular to the first direction, and wherein the first and second sections of the second electrode layer comprise:

a first portion extending horizontally along the second main side of the protection component; and a second portion extend perpendicularly from the first portion, wherein the second portion passes through the second insulation layer and directly contacts only the solder pad, the first section, and the second insulation layer, and wherein the second insulation layer passes completely around the second portion, wherein the first portion of the first section and the first portion of the second section are separated from one another, in the second direction, by the second insulation, and wherein the second insulation extends into the gap.

8. The PTC device of claim 7, further comprising a second solder pad extending along the second insulation layer, wherein the first and second solder pads are not in direct contact with the PTC protection component.

9. The PTC device of claim 7, wherein the first insulation layer and the second insulation layer form an encapsulation covering surrounding each of: the PTC protection component, the first electrode layer, and the second electrode layer.

10. The PTC device of claim 9, wherein the PTC protection component includes the first main side opposite the second main side, an end opposite a second end, a first side opposite a second side, and wherein the encapsulation covering extends over each of: the first main side, the second main side, the end, and the second end.

11. A method of forming a positive temperature coefficient (PTC) device, the method comprising:

providing a PTC protection component;

providing a first electrode layer directly atop a first main side of the PTC protection component, wherein the first electrode layer extends in a first direction, between a first end and a second end of the PTC protection component;

providing a second electrode layer in direct contact with a second main side of the PTC protection component;

providing a first insulation layer over the first electrode layer, and providing a second insulation layer over the second electrode layer; and provide a solder pad in direct contact with only the second electrode layer and the second insulation layer, wherein the second electrode layer includes a first section separated from a second section by a gap, wherein the gap extends in a second direction, perpendicular to the first direction, and wherein the first and second sections of the second electrode layer comprise:

a first portion extending horizontally along the second main side of the protection component; and a second portion extend perpendicularly from the first portion, wherein the second portion passes through the second insulation layer and directly contacts only the solder pad, the first section, and the second insulation layer, wherein the second insulation layer passes completely around the second portion, wherein the first portion of the first section and the first portion of the second section are separated from one another, in the second direction, by the second insulation, and wherein the second insulation extends into the gap.

12. The method of claim 11, further comprising forming a second solder pad along the second insulation layer, wherein the first and second solder pads are not in direct contact with the PTC protection component.

13. The method of claim 12, further comprising providing an encapsulation covering around each of: the PTC protection component, the first electrode layer, and the second electrode layer, wherein the first and second solder pads extend over the encapsulation covering.

* * * * *